US006554520B2

(12) United States Patent
Tsuchiya

(10) Patent No.: US 6,554,520 B2
(45) Date of Patent: Apr. 29, 2003

(54) LIQUID APPLICATOR

(75) Inventor: Eiji Tsuchiya, Fujioka (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/075,366

(22) Filed: Feb. 15, 2002

(65) Prior Publication Data

US 2002/0154939 A1 Oct. 24, 2002

(30) Foreign Application Priority Data

Feb. 16, 2001 (JP) ..... 2001-040575

(51) Int. Cl.[7] ..... A45D 34/04

(52) U.S. Cl. ..... 401/178; 401/179; 401/272; 401/275; 401/279; 401/286; 401/288

(58) Field of Search ..... 401/178, 179, 401/272, 275, 279, 288, 286, 131

(56) References Cited

U.S. PATENT DOCUMENTS 5,073,058 A * 12/1991 Fukuoka et al. ..... 401/206 X
5,176,461 A 1/1993 Kimura
5,707,164 A * 1/1998 Iwamoto et al. ..... 401/206 X

FOREIGN PATENT DOCUMENTS

| | | |
|---|---|---|
| EP | 0 193 299 A1 | 9/1986 |
| GB | 2173743 A | 10/1986 |
| JP | 63-115479 | 7/1988 |

* cited by examiner

*Primary Examiner*—Gregory Huson
*Assistant Examiner*—Kathleen J. Prunner
(74) *Attorney, Agent, or Firm*—Burns, Doane, Swecker & Mathis, LLP

(57) ABSTRACT

A liquid applicator includes: an applicator body in which a storage tank for storing a paint is incorporated; brush elements, made up of multiple fiber bundles embedded on a base, parallel to each other in the axial direction so that the fiber bundles are directed forwards; and a valve element provided in the storage tank for allowing supply of the paint to the brush elements in the applying portion. This liquid applicator further has inside its front barrel, a blocking element formed with a liquid flow passage so as to block the paint supplied from the storage tank whilst partly allowing the paint to be supplied to the tip side of the front barrel by way of the flow passage.

3 Claims, 4 Drawing Sheets

LIQUID APPLICATOR

BACKGROUND OF THE INVENTION (1) Field of the Invention

The present invention relates to a liquid applicator for application of a liquid paint such as a liquid foundation or the like, and in particular relates to a liquid applicator having fiber bundles embedded therein.

(2) Description of the Prior Art

Conventionally, there have been various types of applicators for applying liquid paints such as liquid foundations and the like, which comprise a storage tank portion for storing a paint and an applying portion having a number of fiber bundles embedded on a base so as to supply the fiber bundles with the paint from the storage tank portion. In a typical configuration, a shut-off valve mechanism is provided between the storage tank portion and the applying portion so as to deliver the paint to the applying portion, as appropriate.

It is difficult, however, for an applicator using such fiber bundles to supply a multiple number of fiber bundles with a uniform amount of paint. That is, there occur problems in that the paint retention of the fiber bundles may differ one from another, causing uneven application on the applied surface, or in that if an excessive amount of paint is supplied to the fiber bundles the paint may drip therefrom.

To deal with these problems, a liquid applicator 100, for example, has been proposed by Japanese Utility Model Application Laid-Open Sho 63 No.115479, in which, as shown in FIG. 1, a storage tank portion 120 has a shut-off valve mechanism 122, which permits a paint to be supplied to an applying portion 111 as appropriate while applying portion 111 delivers the paint thus supplied, to fiber bundles 111*a* by way of a liquid impregnated material 115 having continuous pores. With this method, the paint can be gradually supplied to fiber bundles 111*a* via liquid impregnated material 115, so that is it possible to prevent an abrupt excessive supply of the paint and occurrence of uneven paint application on the applied surface.

Further, in the prior art, the way a liquid is supplied is different dependent on the viscosity of the liquid used.

In a case, for example, where a liquid having a relatively high viscosity of 1000 mPa·s or greater is used, the liquid can be directly supplied to applying portion 111 from storage tank portion 120 without causing any splash when the liquid is ejected. On the other hand, when a liquid having a relatively low viscosity of 100 mPa·s or lower is used, provision of liquid impregnated material 115 such as sponge or the like between storage tank portion 120 and applying portion 111 as stated above makes it possible to retain the liquid at applying portion 111 and hence prevent spatter when the liquid is ejected.

However, when a liquid having a viscosity ranging from 100 to 1000 mPa·s is used, if the liquid is directly supplied from storage tank portion 120 to applying portion 111, the problem of the liquid splatter occurs when the liquid is ejected. In contrast, when the liquid is supplied by way of liquid impregnated material 115 as stated above, another problem occurs in that the liquid clogs the pores in liquid impregnated material 115, disabling air replacement, which makes ejection of the liquid difficult.

SUMMARY OF THE INVENTION

The present invention has been devised in view of the above conventional problems, it is therefore an object of the present invention to provide a liquid applicator of a simple configuration which can supply a liquid to its applying portion without causing any uneven application on the applied surface or causing any liquid drip due to excessive supply and can still prevent occurrence of splatter when the liquid is ejected.

In order to achieve the above object, the present invention is configured as follows:

In accordance with the first aspect of the present invention, a liquid applicator includes: an applicator body in which a storage tank portion for storing a liquid is incorporated; an applying portion disposed on the front end side of the applicator body, in which a plurality of fiber bundles are embedded parallel to each other in the axial direction so that the fiber bundles are directed forwards; and a shut-off valve mechanism disposed in the storage tank portion for allowing supply of the liquid to the applying portion, and is characterized in that the applying portion includes a blocking element formed with a liquid flow passage so as to block the liquid supplied from the storage tank portion whilst partly allowing the liquid to be supplied to the tip side by way of the flow passage.

In accordance with the second aspect of the present invention, the liquid applicator having the above first feature is characterized in that the applying portion includes a base formed with an open portion at the approximate center through which the blocking element is arranged and having fiber bundles embedded around the open portion.

In accordance with the third aspect of the present invention, the liquid applicator having the above second feature is characterized in that the blocking element has a bar-like or plate-like configuration substantially parallel to the direction of the liquid to be ejected and has a hold to be kept by the base when the blocking element is set to the open portion.

In accordance with the fourth aspect of the present invention, the liquid applicator having the above third feature is characterized in that the blocking element has a cutout that opens toward the storage tank side, forming an approximate U-shape in the plan view and is configured so that when the blocking portion is set to the open portion, part of the cutout is positioned further to the front side beyond the open portion, creating fluid communication between the tip side of the applying portion and the storage tank side by way of the cutout.

According to the present invention the following effects can be obtained.

That is, since the liquid applicator is configured so that the liquid is supplied from the storage tank portion to a number of fiber bundles in the applying portion by way of a shut-off valve mechanism, it is possible to achieve appropriate supply of the liquid to the applying portion without causing any uneven liquid distribution across the fiber bundles.

Further, since the applying portion has a blocking element formed with a liquid flow passage so as to block the liquid supplied from the storage tank portion whilst partly allowing the liquid to be supplied to the tip side by way of the flow passage, it is possible to achieve the optimal amount of liquid supply by forming a passage in conformity with the liquid viscosity. Thus, regardless of a liquid having a high or low viscosity, it is possible to supply the liquid to the fiber bundles without causing spatter.

Since the applying portion includes a base formed with an open portion at the approximate center through which the blocking element is arranged and having fiber bundles embedded around the open portion, the liquid supplied through the open portion from the blocking element can be uniformly distributed across the fiber bundles.

Since the blocking element has a bar-like or plate-like configuration substantially parallel to the direction of the liquid to be ejected and has a hold to be kept by the base when the blocking element is set to the open portion, the blocking element can be formed in a simple manner and can be mounted to the applying portion with a simple means.

Since the blocking element has a cutout that opens toward the storage tank side, forming an approximate U-shape in the plan view and is configured so that when the blocking portion is set to the open portion, part of the cutout is positioned further to the front side beyond the open portion, creating fluid communication between the tip side of the applying portion and the storage tank side by way of the cutout, it is possible to bring the liquid supplied from the storage tank portion to the front end side of the applying portion.

DESCRIPTION OF THE PREFERRED EMBODIMENTS

Figure 1:
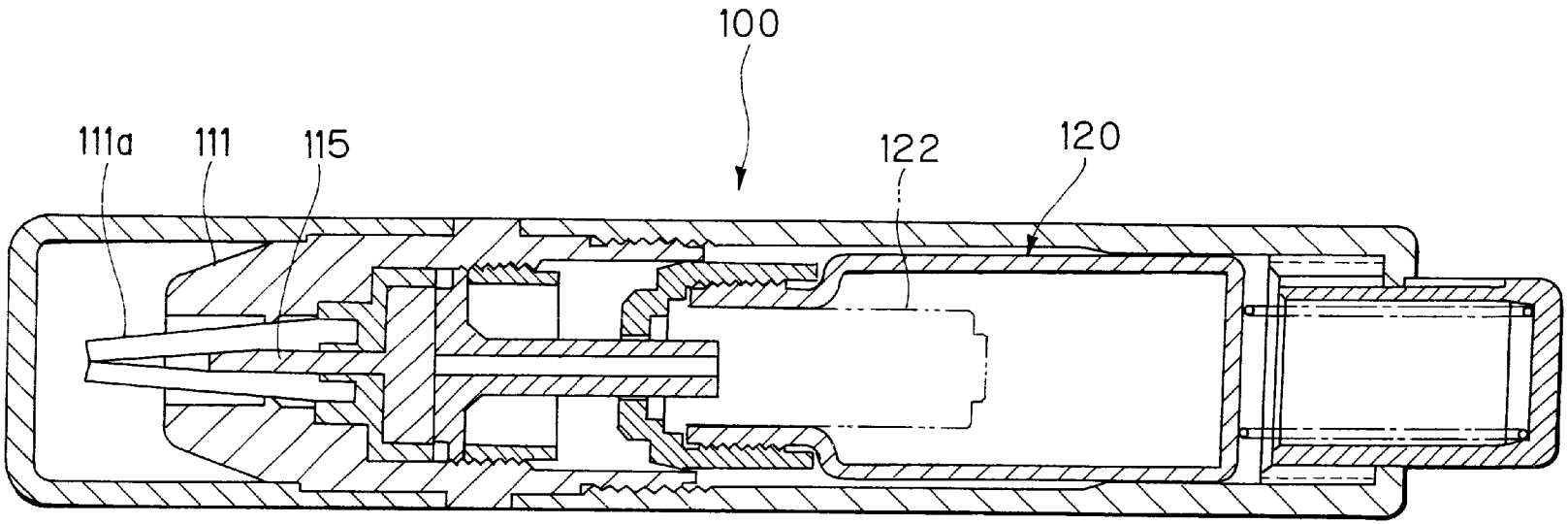
FIG. 1 PRIOR ART
FIG. 1 is a sectional view showing the detailed, whole configuration of a conventional liquid applicator.

The embodiment of the present invention will hereinafter be described in detail with reference to the accompanying drawings.

FIGS. 2 through 6 show one example of the embodiment of the present invention, wherein like reference numerals designate identical components and the basic configuration is the same as that of the illustrated conventional configuration.

Figure 2:
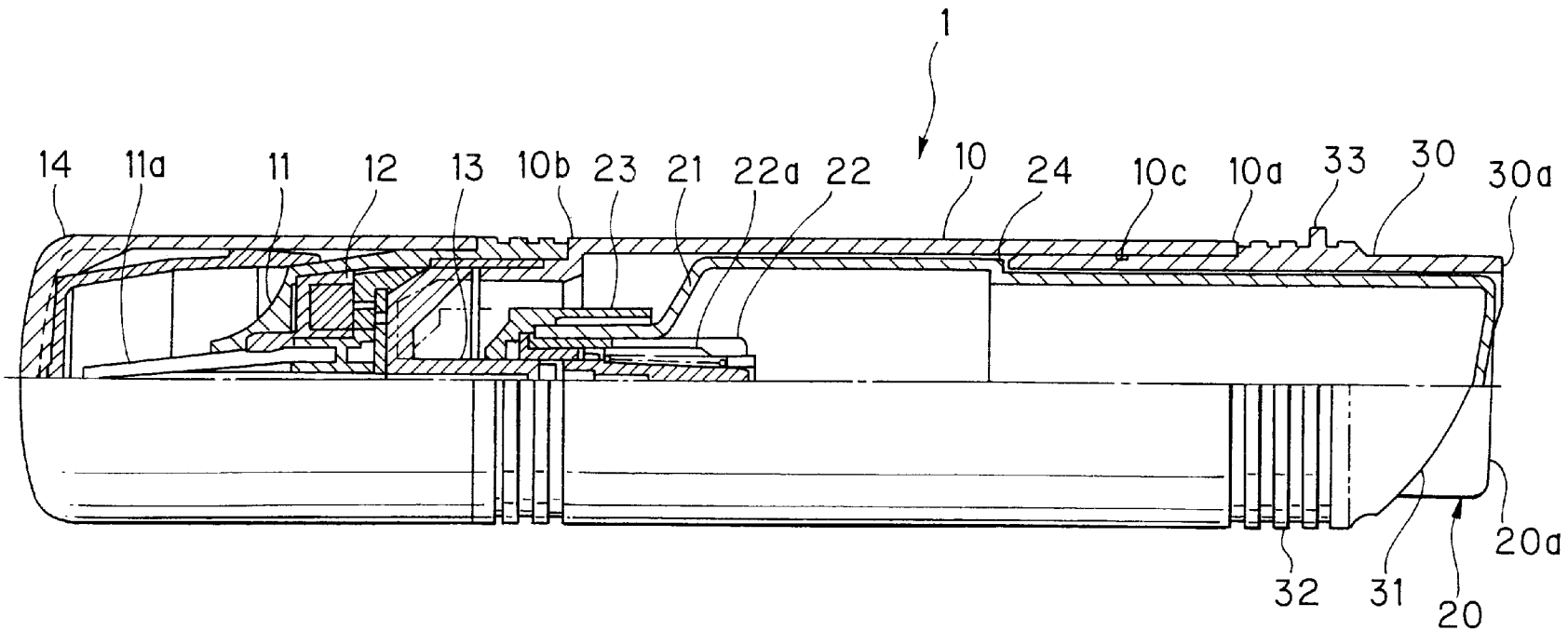
FIG. 2 is a sectional partial cutaway view showing the detailed, whole configuration of a liquid applicator according to the embodiment of the present invention.
Figure 3:
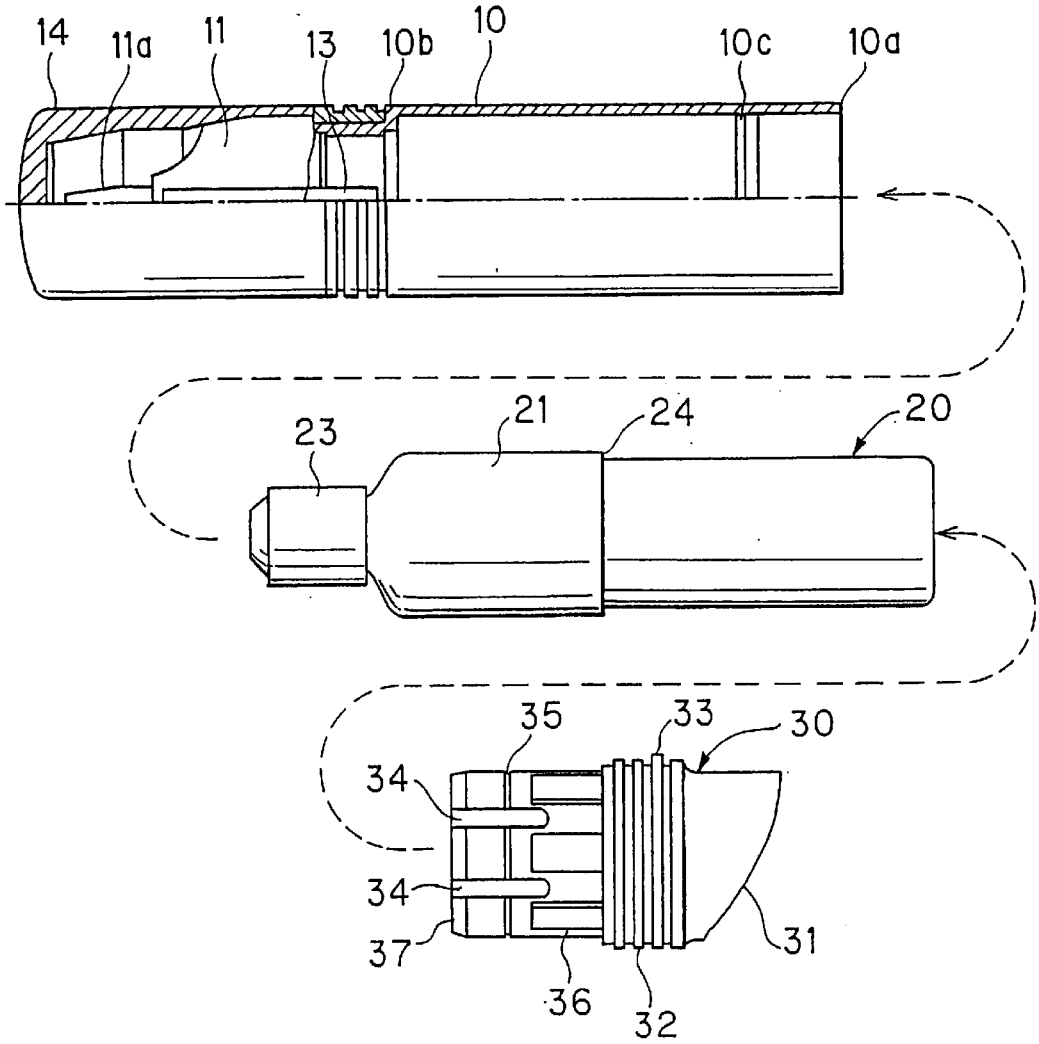
FIG. 3 is an illustrative view showing the way the liquid applicator is assembled.
Figure 4:
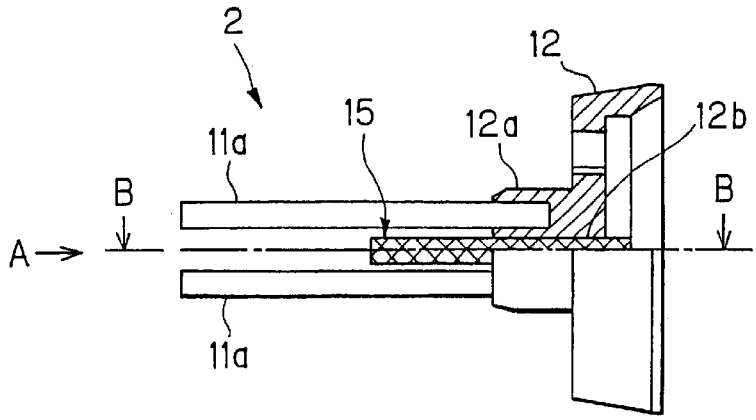
FIG. 4 is a sectional partial cutaway view showing the configuration of an applying portion of the liquid applicator.
Figure 5:
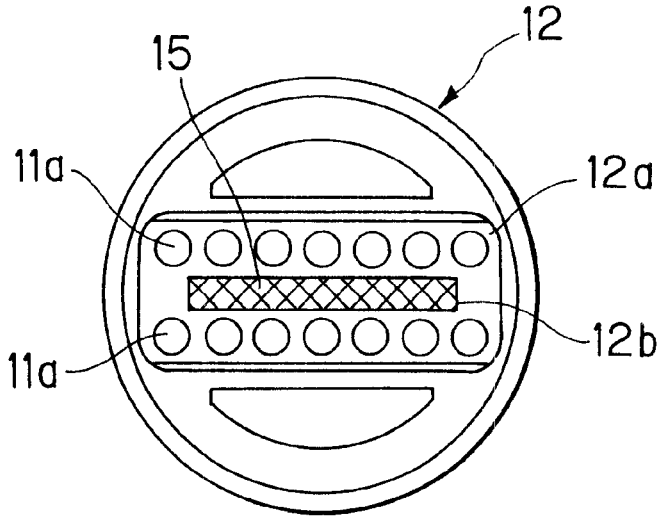
FIG. 5 is a view seen in the direction of an arrow A shown in FIG. 4.
Figure 6:
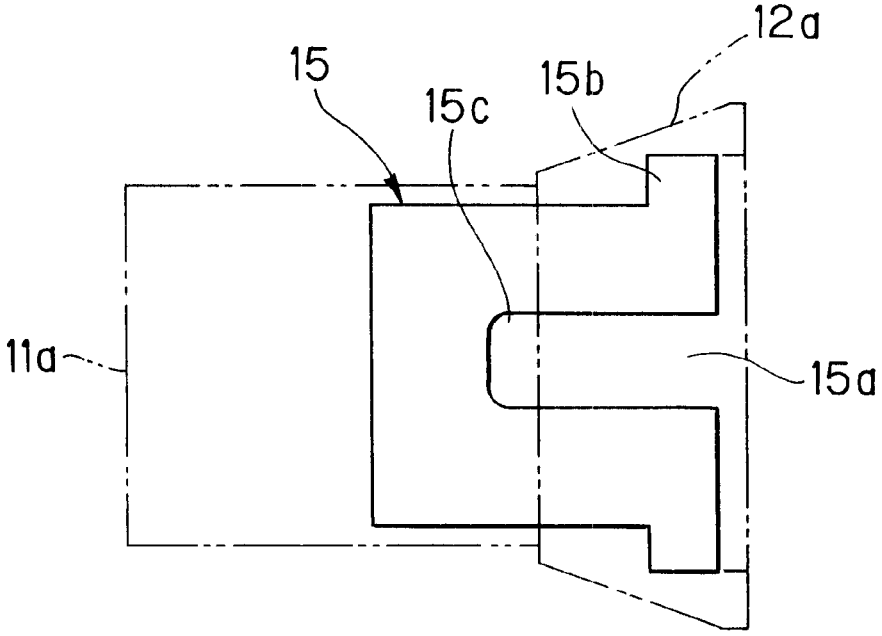
FIG. 6 is a sectional view cut along a B—B plane in FIG. 4.

FIG. 2 is a sectional partial cutaway view showing the detailed, whole configuration of a liquid applicator according to the embodiment of the present invention; FIG. 3 is an illustrative view showing the way the liquid applicator is assembled; FIG. 4 is a sectional partial cutaway view showing the configuration of an applying portion 2 of the liquid applicator of the present embodiment; FIG. 5 is a view seen in the direction of an arrow A shown in FIG. 4; and FIG. 6 is a sectional view cut along a B—B plane in FIG. 4.

A liquid applicator 1 in accordance with the present embodiment is comprised of, as shown in FIGS. 2 and 3, a cylindrical applicator body 10, a cartridge type storage tank 20 to be accommodated inside applicator body 10 and a tail plug 30 disposed at the rear end of applicator body 10 for holding the storage tank 20.

Liquid applicator body 10 is made of a synthetic resin and formed in an approximate cylindrical form with its rear end portion 10*a* opened and its front end portion 10*b* integrally formed with a front barrel 11. An annular projected fitting portion 10*c* which is substantially perpendicular to the axis is formed on the inner surface near rear end portion 10*a*.

Attached to the front barrel 11 is a base 12 on which brush elements 11*a* of fiber bundles are embedded so that the fiber bundles are projected forwards. A pipe 13 for supplying a liquid to the brush elements 11*a* is disposed at the rear of the base 12.

As shown in FIGS. 4 and 5 the base 12 has an approximately disk-like configuration having a hollow on the rear side while an approximately rectangular brush embedment portion 12*a*, projected forwards from the front side, is formed along the diameter of the base 12.

A rectangular open portion 12*b* is formed penetrating through the approximate center of the brush embedment portion 12*a* in the front-to-rear direction, as shown in FIG. 5 while a multiple number of brush elements 11*a* are embedded in two parallel rows along the length of open portion 12*b* with the open portion in between.

As shown in FIG. 5, a plate-like blocking element 15 is disposed substantially parallel to the direction of ejection of the liquid between the rows of the brush elements 11*a*, penetrating through the open portion 12*b*.

This blocking element 15 has a substantially rectangular configuration in the plan view, with a cutout 15*a* that opens toward the storage tank 20 side, forming a U-shape. Further, a pair of holds 15*b* are formed on both sides across the width of the blocking element so that they can be kept by base 12 when the blocking element is set to open portion 12*b*.

This blocking element 15 is configured so that when it is set to open portion 12*b*, part of the cutout 15*a* is positioned further to the front side beyond open portion 12*b*, creating a liquid passage 15*c* so as to establish fluid communication between the tip side of the applying portion and the storage tank 20 side by way of the cutout 15*a* with the liquid flow passage 15*c* forming a part.

The aforementioned pipe 13 is fixed to front barrel 11 and disposed so as to be projected to the rear in the front end part inside applicator body 10. Designated at 14 in the drawings is a cap fitted to front barrel 11.

Storage tank 20, as shown in FIG. 2, stores the liquid such as a foundation etc., in tank body 21 and has a valve element 22 mounted at the front end opening thereof and a synthetic resin-made inner front barrel 23 fitted on the outer periphery at the front end thereof so as to cover the valve element 22. A step 24 facing rearwards is formed on the outer periphery of the tank body 21.

The aforementioned tail plug 30 is of a synthetic resin-made cylinder with both ends open, as shown in FIGS. 2 and 3, and has a cutout portion 31 at the rear end side and a stepped portion 32 for preventing skidding upon fitting formed at the side near the rear end and an anti-rolling projection 33 formed on the outer side.

The tail plug 30 also has a recessed fitting portion 35 which has parallel slits 34, 34 extending in the axial direction so that the tail plug can be removably fitted into projected fitting portion 10*c* of applicator body 10 by the appropriate fastening margins. This tail plug further has a joint portion 36, which has a greater outside diameter, to be inserted into applicator body 10 and is formed in the rear of the recessed fitting portion.

Next, the way of assembly of the applicator body 10 of the applicator 1, storage tank 20 and tail plug 30 will be described.

As shown in FIG. 3, to begin with, tail plug 30 is fitted on and slid along storage tank 20 from the rear side of storage tank 20 until front end opening 37 of tail plug 30 abuts step 24 of storage tank 20. Then, the tail plug 30 thus fitted together is inserted into applicator body 10 from the open side at the rear end portion 10*a*.

Thereby, as the tail plug 30 is inserted, the peripheral parts between slits 34 deflect inwards narrowing the slits 34 within the appropriate fastening margins, so that the recessed fitting portion 35 on tail plug 30 is fitted and fixed to the projected fitting portion 10*c* of applicator body 10 while the opening of inner front barrel 23 of storage tank 20 is fitted on the pipe 13 inside applicator body 10. Thus, the assembly is completed.

In this state, rear end 20*a* of storage tank 20 is projected to the rear by a predetermined length beyond the rear end 10*a* of applicator body 10, as shown in FIG. 2.

Next, the usage of the liquid applicator 1 will be described.

As shown in FIG. 2, storage tank 20 is able to axially slide relative to pipe 13. When rear end 20*a* of storage tank 20 is pushed forwards, valve element 22 of storage tank 20 opens so that the liquid in storage tank 20 flows into pipe 13 through valve element 22 and is supplied to brush elements 11*a*.

When pressure at the rear end of storage tank 20 is released, the storage tank 20 moves backwards relative to pipe 13 by virtue of a valve spring 22*a* incorporated in valve element 22 to thereby shut off the valve element 22 while step 24 of storage tank 20 abuts front end opening 37 of tail plug 30 and stops at that position so as to prevent valve element 22 incorporated in storage tank 20 from coming off pipe 13 when storage tank 20 is slid to the tail plug 30 side upon pressing (clicking) storage tank 20 or when a force acts accidentally.

The rear portion of tail plug 30, located behind joint portion 36 covers the rear peripheral part of storage tank 20 projected to the rear from the rear end of applicator body 10 and the rear end brim, designated at 30*a*, of tail plug 30 is flush with, or located further rear than, the rear end 20*a* of storage tank 20. This arrangement makes it possible for rear plug 30 to prevent the rear end face of storage tank 20 from being clicked accidentally, and yet storage tank 20 can be pushed forwards at cutout portion 31 of tail plug 30 so as to supply the liquid from storage tank 20 to brush elements 11*a*.

Ejection tests were carried out using the liquid applicator 1 configuration according to the present embodiment, with different setups. The results are shown as example 1 and comparative examples 1 and 2.

(1) Liquid Applicator Setups

EXAMPLE 1

Example 1 was implemented using a liquid applicator 1 shown in FIG. 2, having a blocking element 15 according to the present embodiment set to open portion 12*b* of base 12 and a liquid having a viscosity of about 500 mPa·s charged therein.

Comparative Example 1

Comparative example 1 was implemented using a liquid applicator 1 shown in FIG. 2 having a sponge element mounted to open portion 12*b* of base 12 and a liquid having a viscosity of about 500 mPa·s charged therein.

Comparative Example 2

Comparative example 2 was implemented using a liquid applicator 1 shown in FIG. 2 having no element mounted to open portion 12*b* of base 12 and a liquid having a viscosity of about 500 mPa·s charged therein.

(2) Testing Method of Ejection Performance

1) Number of Clicks

The number of clicking actions for liquid ejection, repeated from the initial state until the liquid reached the tips of fiber bundles was measured.

Five samples of each applicator type were tested and the average was calculated for evaluation.

It was determined that the lesser the number of clicking actions, the better the liquid was ejected.

2) Average Amount of Ejection

The ejected amount of liquid per ten clicking actions was measured by repeatedly performing clicks for liquid ejection.

The average of the ejected amount for each applicator was calculated.

Five samples of each applicator type were tested and the average was calculated for evaluation.

It was determined that the higher the average amount of ejection, the better the liquid was ejected.

3) Liquid Splatter

After making clicking actions for liquid ejection, it was checked whether splatter occurred when the liquid was ejected.

Absence of liquid splatter was determined to be beneficial.

(3) Comparison of the Ejection Performance Test Results

| | Number of Clicks | Average Amount of Ejection | Liquid Splatter |
|---|---|---|---|
| Example 1 | 17.4(clicks) | 0.11 (g/ten clicks) | Not found |
| Comparative Example 1 | 130.0(clicks) | 0.09 (g/ten clicks) | Not found |
| Comparative Example 2 | 10.4(clicks) | 0.12 (g/ten clicks) | Found |

From the above test results, no liquid splattered during liquid ejection in example 1 and comparative example 1. In particular, it is understood that example 1 is more excellent in ejection performance and in average amount of ejection than comparative example 1.

In conclusion, according to the liquid applicator 1 of the present embodiment, it is possible to realize excellent ejection performance without causing any liquid splatter during liquid ejection.

As has been described, according to the present embodiment, a blocking element 15 which has a plate-like configuration and is disposed substantially parallel to the ejected direction of the liquid is formed with a cutout 15*a* so as to open toward storage tank 20 side, forming a U-shape in the plan view. Thus this simple arrangement makes it possible to create a liquid flow passage 15*c*.

Further, in the present embodiment, it possible to achieve optimal liquid supply in conformity with the utility by changing blocking element 15 and/or cutout portion 15*a* in size and shape without the necessity of any modification of front barrel 11.

Though in the present embodiment the liquid is assumed to a paint, the present invention should not be limited by the liquid type, the materials and the like. For example, other than liquid cosmetics, the present embodiment may be used for liquid shoe polish, nail polish as well as for liquid glue, liquid paints and liquid medicines, and may be applied to the aerosol types of these.

Further, in the present embodiment, though blocking element 15 is formed with cutout portion 15*a* so as to establish fluid communication, the present invention should not be limited to this as long as a passage permitting liquid flow can be established. For example, open portion 12*b* and blocking element 15 may be configured so as to loosely fit to each other so that clearance can be formed between open portion 12*b* and blocking element 15, which is made to serve as the liquid passage. Alternatively, partial flow channels may be formed between open portion 12*b* and blocking element 15.

The liquid applicator according to the present embodiment is configured and used as described heretofore. However, the present invention should not be limited to the above embodiment and various changes and modifications in design may be added without departing from the scope of the present invention.

The liquid applicator of the present invention thus described heretofore has a simple configuration, and yet is effective in supplying a liquid to its applying portion without causing any uneven application on the applied surface or causing any liquid drip due to excessive supply and can still prevent occurrence of splatter when the liquid is ejected.

That is, since the liquid applicator is configured so that the liquid is supplied from the storage tank portion to a number of fiber bundles in the applying portion by way of a shut-off valve mechanism, it is possible to achieve appropriate supply of the liquid to the applying portion without causing any uneven liquid distribution across the fiber bundles.

Further, since the applying portion has a blocking element formed with a liquid flow passage so as to block the liquid supplied from the storage tank portion whilst partly allowing the liquid to be supplied to the tip side by way of the flow passage, it is possible to achieve the optimal amount of liquid supply by forming a passage in conformity with the liquid viscosity. Thus, regardless of a liquid having a high or low viscosity, it is possible to supply the liquid to the fiber bundles without causing spatter.

What is claimed is:

1. A liquid applicator comprising:

an applicator body in which a storage tank portion for storing a liquid is incorporated;

an applying portion disposed on a front end side of the applicator body, in which a plurality of fiber bundles are embedded parallel to each other in an axial direction so that the fiber bundles are directed forwards, and a shut-off valve mechanism disposed in the storage tank portion for allowing supply of the liquid to the applying portion, wherein the applying portion includes a blocking element formed with a liquid flow passage so as to block the liquid supplied from the storage tank portion whilst partly allowing the liquid to be supplied to a tip side by way of the flow passage;

wherein the blocking element has a cutout that opens toward a storage tank portion side and forms an approximate U-shape in plan view and is configured so that when the blocking element is set to the open portion, part of the cutout is positioned further to a front side beyond the open portion, creating fluid communication between the tip side of the applying portion and the storage tank portion side by way of the cutout.

2. The liquid applicator according to claim 1, wherein the applying portion includes a base formed with the open portion at the approximate center through which the blocking element is arranged and having the fiber bundles embedded around the open portion.

3. The liquid applicator according to claim 2, wherein the blocking element has a bar-like or plate-like configuration substantially parallel to a direction of the liquid to be ejected and has a hold to be kept by the base when the blocking element is set to the open portion.

* * * * *